US007241118B2

(12) United States Patent
Cheng et al.

(10) Patent No.: US 7,241,118 B2
(45) Date of Patent: Jul. 10, 2007

(54) PUMP OF LIQUID BASED COOLING DEVICE

(76) Inventors: Ruei-Fu Cheng, No. 290, Cingnian 1st Rd., Singing District, Kaohsiung City 800 (TW); Ts'ung Chin Chen, 4F, No. 508-1, Hongchang 13th St., Taoyuan City (TW)

( * ) Notice: Subject to any disclaimer, the term of this patent is extended or adjusted under 35 U.S.C. 154(b) by 446 days.

(21) Appl. No.: 10/963,507

(22) Filed: Oct. 14, 2004

(65) Prior Publication Data

US 2005/0186093 A1 Aug. 25, 2005

(30) Foreign Application Priority Data

Feb. 25, 2004 (TW) ..... 93202694 U

(51) Int. Cl.
*F04B 35/04* (2006.01)
*F04B 17/00* (2006.01)

(52) U.S. Cl. ..... 417/423.1; 417/366; 417/423.7

(58) Field of Classification Search ..... 417/352, 417/366, 423.14, 423.7, 410.1, 423.1
See application file for complete search history.

(56) References Cited

U.S. PATENT DOCUMENTS 6,034,465 A * 3/2000 McKee et al. ..... 310/268
6,065,946 A * 5/2000 Lathrop ..... 417/423.14
6,600,649 B1 * 7/2003 Tsai et al. ..... 361/697
7,013,959 B2 * 3/2006 Lee et al. ..... 165/104.33
2005/0092468 A1 * 5/2005 Cheng et al. ..... 165/104.33
2005/0183848 A1 * 8/2005 Cheng et al. ..... 165/104.33
2005/0276703 A1 * 12/2005 Lee et al. ..... 417/410.1
2006/0051222 A1 * 3/2006 Lee et al. ..... 417/423.14
2006/0057001 A1 * 3/2006 Chen ..... 417/423.1
2006/0222533 A1 * 10/2006 Reeves et al. ..... 417/420

* cited by examiner

*Primary Examiner*—William H. Rodriguez
(74) *Attorney, Agent, or Firm*—Rosenberg, Klein & Lee

(57) ABSTRACT

Disclosed is pump for circulating a liquid coolant between a heat generating device and a radiator. The pump includes a casing forming an upper chamber in which a blade assembly comprised of a plurality of blades and a permanent magnet coaxially attached to the blades is rotatably received and a lower chamber accommodating an electrical magnet comprised of silicon steel plates surrounding the permanent magnet. The permanent magnet includes first and second magnet elements coaxially aligned with and stacked to each other. The magnetic poles of the first and second magnet elements are arranged in a non-symmetric alternating manner. In other words, the magnetic poles of the first and second magnet element are angularly shifting an angle that does not correspond to 90 or 180 degrees.

3 Claims, 5 Drawing Sheets

PUMP OF LIQUID BASED COOLING DEVICE

BACKGROUND OF THE INVENTION

1. Field of the Invention

The present invention generally relates to a cooling device using a liquid, such as water, as coolant, for cooling particularly a computer system, and in particular to a pump of the cooling device that circulates the liquid coolant through the cooling device wherein the pump comprises a permanent magnet rotor comprising upper and lower sections having magnetic poles arranged in a non-symmetric alternating manner in order to ensure smooth starting of the pump and to enhance performance of the cooling device.

2. The Related Art

A conventional water pump comprises a single permanent magnet to interact with an electrical magnet that is formed of silicon steel plates inducing a time-variable magnetic field to drive a blade assembly for drawing and expelling water. The permanent magnet is arranged to have north and south poles thereof opposing the magnetic poles of the electric magnet so that the repulsive force between magnetic poles of the magnets rotates the permanent magnet about a constant axis. However, when the permanent magnet is not in rotation, at least one of the magnetic poles of the permanent magnet becomes attractive with an opposite pole of the electric magnet whereby when the pump is started again, such an attraction forces becomes a resistance against the initial rotation of the rotor, and causes vibration or shake when the rotor eventually gets moved. This often results in un-smooth starting of the pump and deteriorates the performance of the cooling system.

Such a problem may get even severer when the cooling device is used to control temperature of high-speed electronic devices, such as a central processing unit of a computer. Due to the fast development of the computer industry, the central processing unit or other electronic devices must process data and instructions in an extreme high speed, which means a great amount of heat is generated in a very short period. Such a fast accumulation of excessive heat must be properly removed. When a conventional cooling device, such as that just described, is employed to cool the electronic devices, the poor performance of the cooling device, even occurring only in a short period at the starting thereof, may probably cause heat damage to the electronic devices due to not timely removing the excessive heat.

Thus, it is desired to provide a liquid based cooling device that eliminates the drawback of non-smooth starting of pump often observed in the conventional designs.

SUMMARY OF THE INVENTION

Thus, a primary objective of the present invention is to provide a liquid based cooling device comprising a pump having a rotor-side permanent magnet comprised of upper and lower sections having magnetic poles arranged in a non-symmetric alternating manner to effectively eliminate the initial resistance caused by magnetic attraction.

Another objective of the present invention is to provide a liquid based cooling device comprising a pump that can be started smoothly and effortlessly and thus having enhanced cooling performance.

To achieve the above objectives, in accordance with the present invention, a pump is provided, which is employed in a liquid-based cooling device for circulating a liquid coolant to remove heat from for example a computer system. The cooling device comprises coolant conduits connecting the pump between a heat radiator and a coolant tray. The coolant tray is a flat container through which the coolant flows. The coolant tray has a bottom face of a large area positionable and in physical engagement with a heat generating device, such as an electronic device of the computer system, to allow the coolant flowing therethrough to absorb and thus remove the heat generated inside the heat generating device. The radiator comprises a plurality of fins arranged to form air passages therebetween and a fan to cause airflows through the air passages to induce force convection. The heat is carried by the coolant to the radiator and dissipated from the fins by the airflows.

The pump comprises a casing defining upper and lower chambers. The upper chamber has an opening closed by a lid, defining an interior space in which a blade assembly is rotatably supported. A coolant inlet is formed in the lid, guiding the coolant from the radiator into the interior space, which coolant is then expelled by the rotation of the blade assembly to flow through an outlet formed in the upper chamber to the coolant tray. The blade assembly comprises a plurality of blades extending from a hub and a permanent magnet coaxially and securely mounted to the hub. A cylinder extends from the upper chamber into the lower chamber, defining a bore or space rotatably accommodating the permanent magnet. An electric magnet formed of a plurality of silicon steel plates arranged around the cylinder is accommodated in the lower chamber, whereby energizing the electrical magnet induces a magnetic force interacting between the permanent magnet and the electrical magnet to drive the rotation of the blade assembly.

The permanent magnet is comprised of an upper magnet element and a lower magnet element fixed together. Each magnet element is cylindrical and is comprised of two semi-circular magnetic poles, namely north and south poles. The upper and lower magnet elements are coaxially stacked on each other and are arranged so that the magnetic poles are alternating each other in a non-symmetric manner. In other words, the poles of the upper and lower magnet elements are angularly offset an angle rather than 90 or 180 degrees or a multiplicity of 90 or 180 degrees. This ensures at least one of the magnet elements are in magnetic repulsion with respect to the electric magnet even when the blade assembly is not in rotation.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
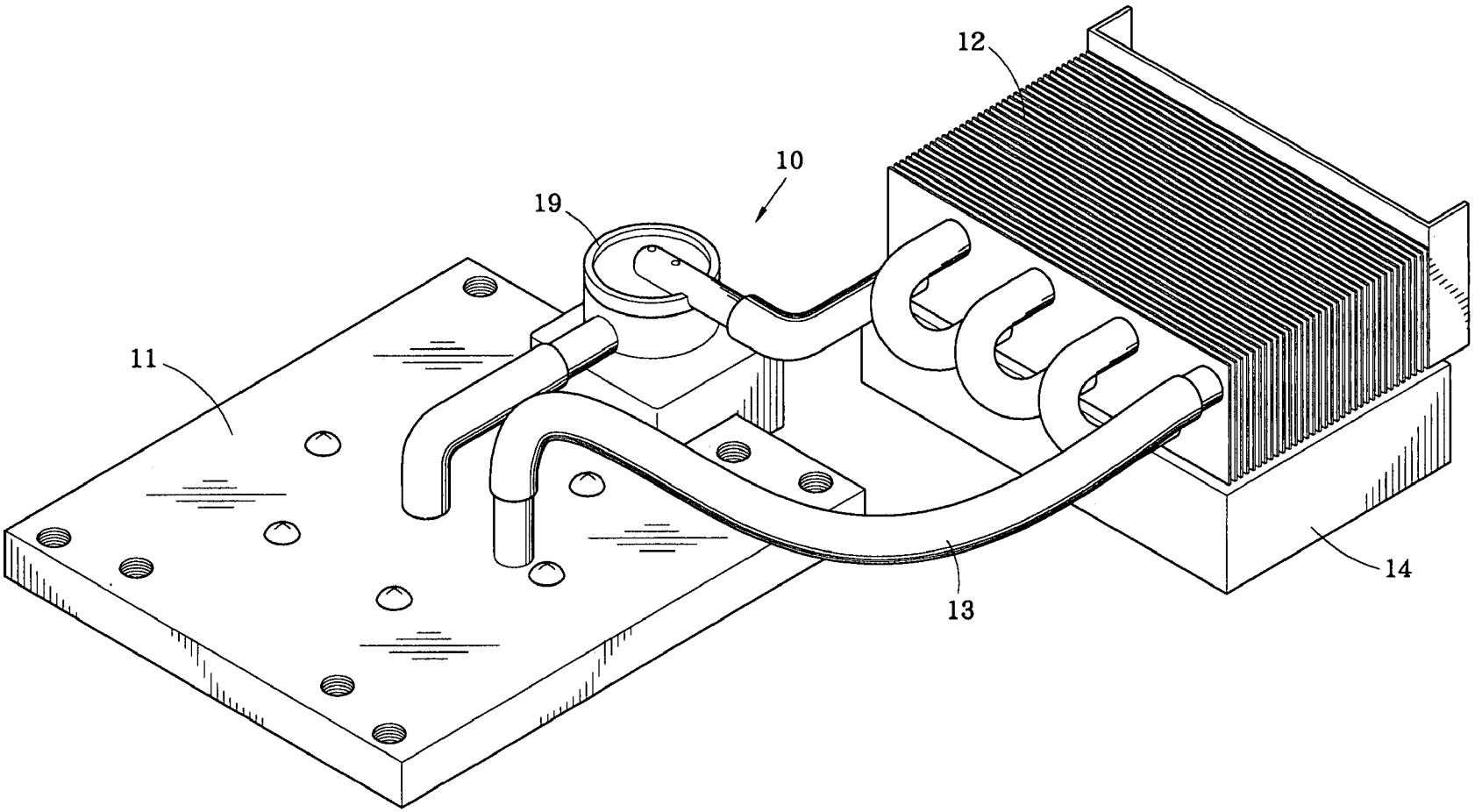
FIG. 1 is a perspective view of a cooling device in which a pump constructed in accordance with the present invention is incorporated.

With reference to the drawings and in particular to FIG. 1, a cooling device is shown. The cooling device is operated with a liquid coolant, such as water, for cooling for example electronic devices of a computer system. The cooling device is comprised of a coolant tray 11 having a large surface area for physical contact with a heating generating device, such as a central processing unit of the computer system. The coolant tray 11 forms an interior space (not shown) through which the coolant flows to remove heat generated by the heat generating device. The coolant is guided by piping 13 to a radiator 12, which comprises a plurality of spaced fins 12 between which air passages (not labeled) are defined to guide airflows generated by a fan 14. Heat carried by the coolant to the radiator 12 is thus subject to force convection and dissipates into the surroundings.

The cooling device 10 further comprises a pump constructed in accordance with the present invention, generally designated with reference numeral 10, which drives the coolant from the radiator 12 to the coolant tray 11, thus inducing circulation of the coolant between the coolant tray 11 and the radiator 12.

Figure 2:
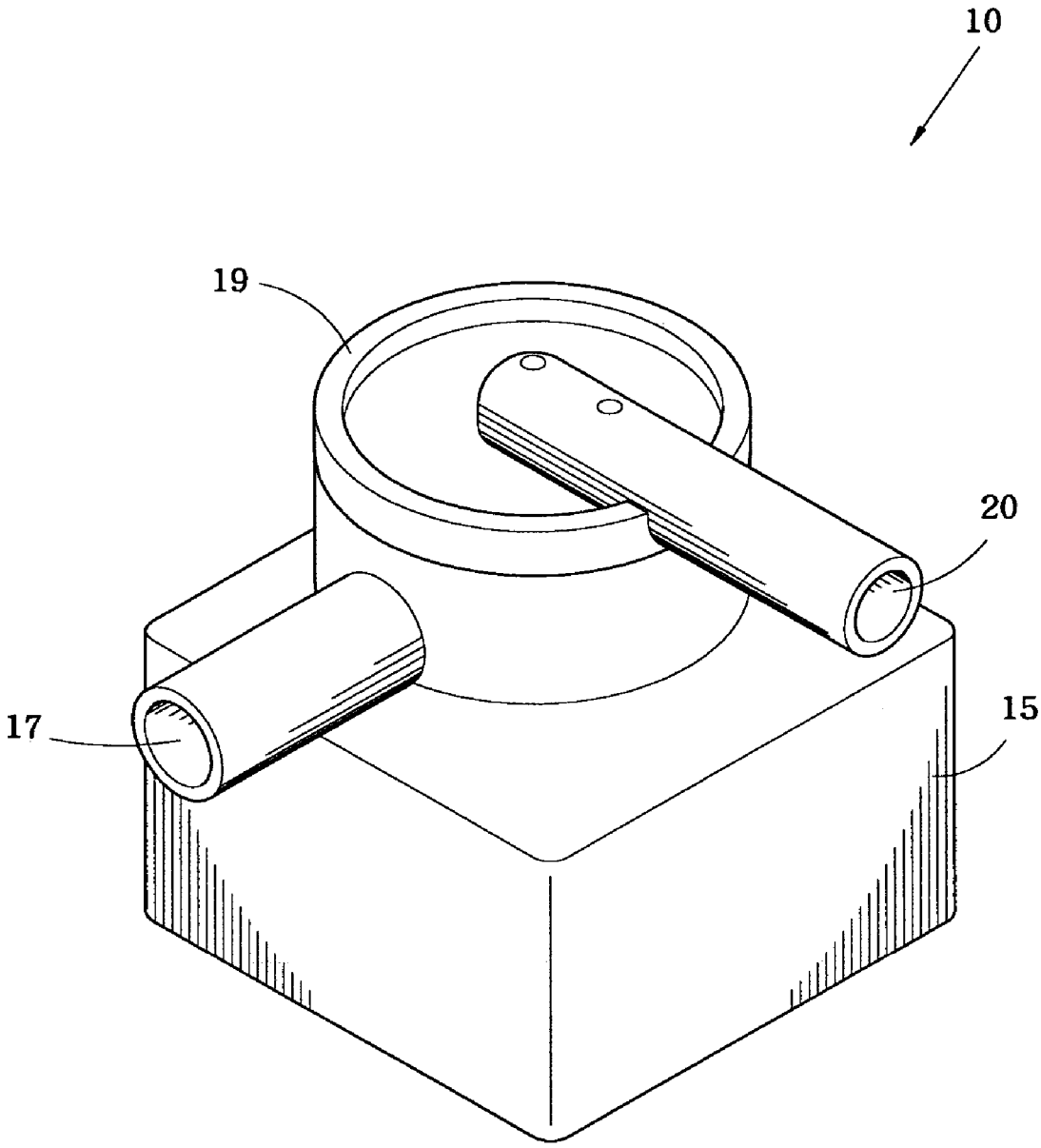
FIG. 2 is a perspective view of the pump in accordance with the present invention.
Figure 3:
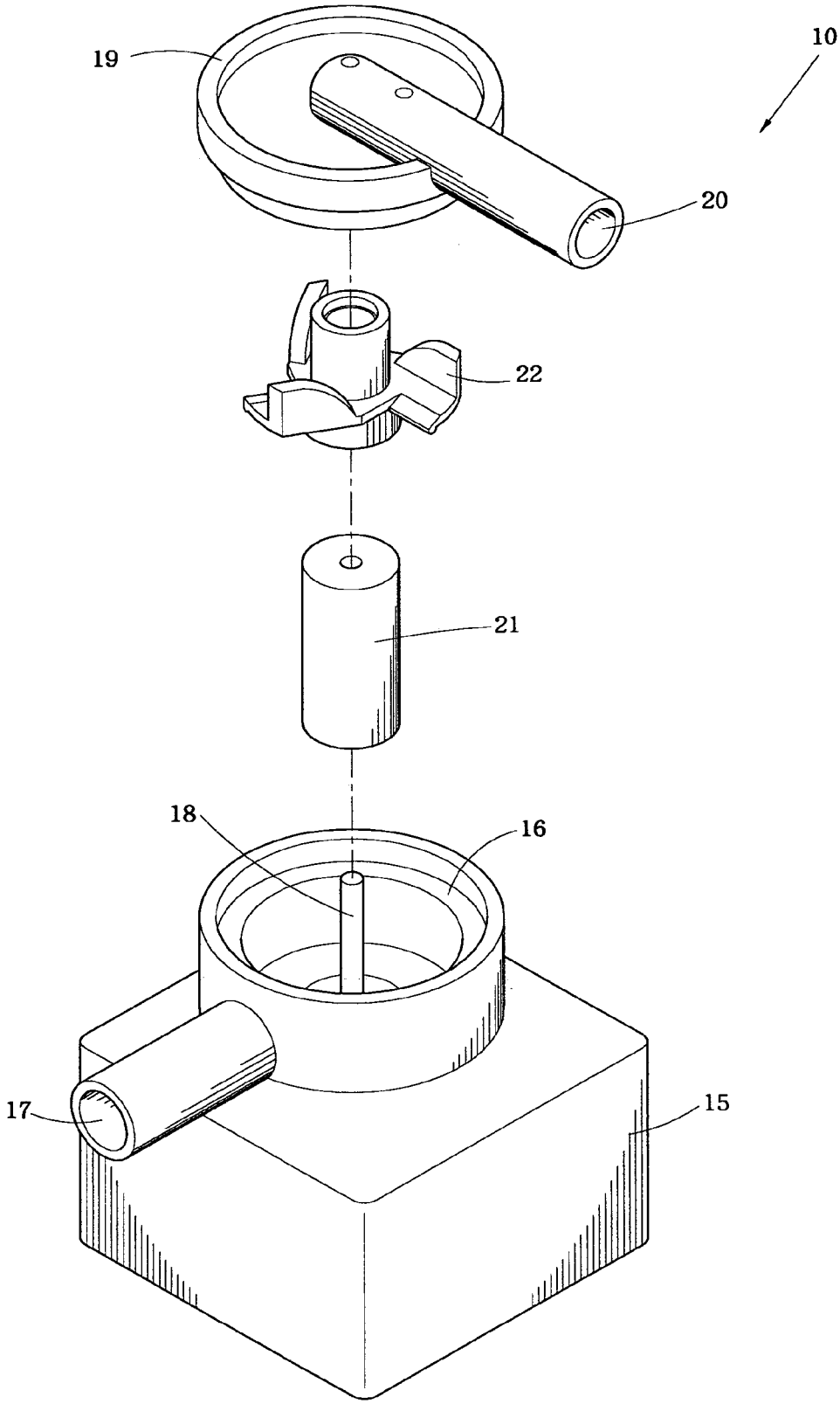
FIG. 3 is an exploded view of the pump of the present invention.
Figure 4:
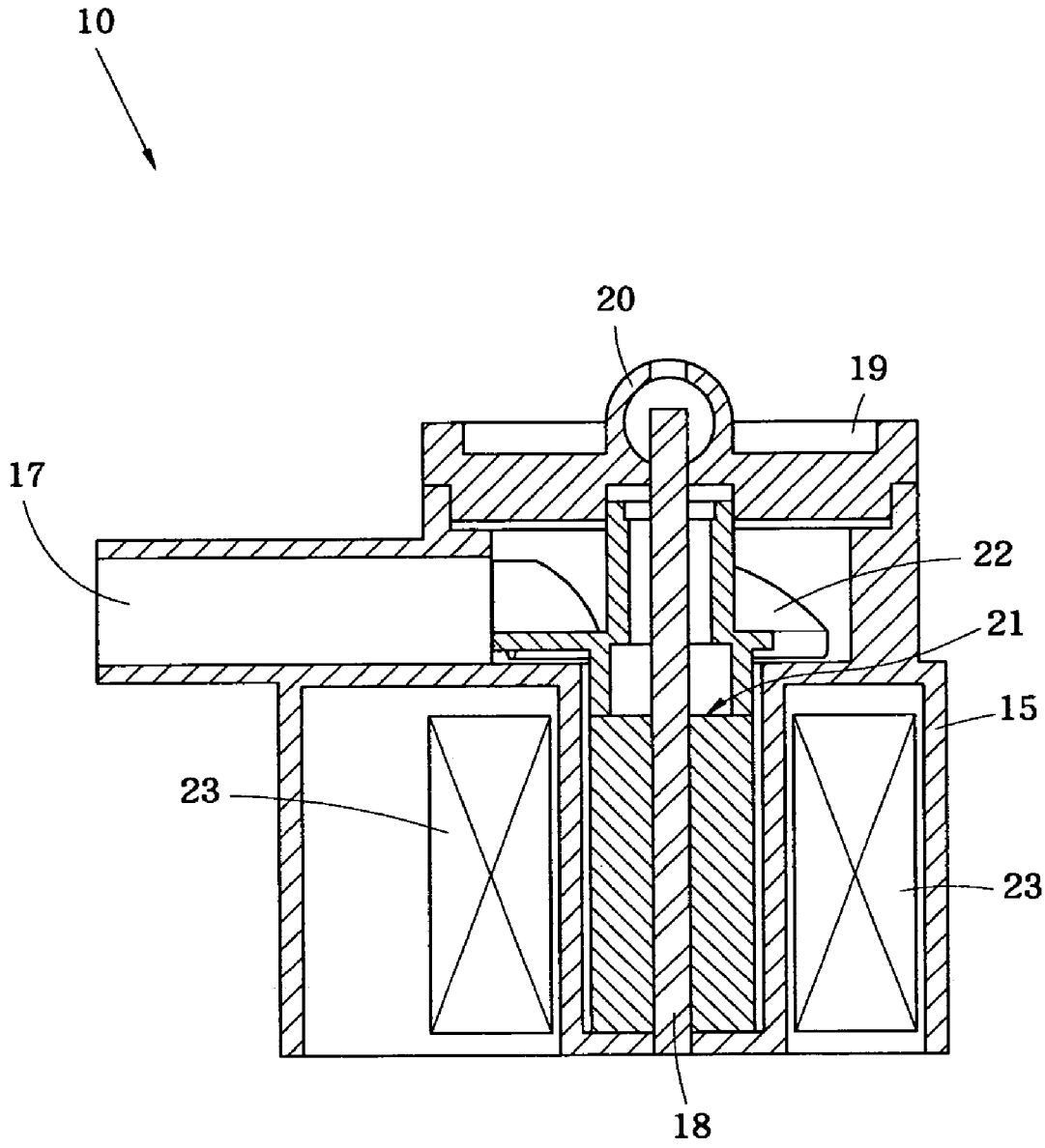
FIG. 4 is a cross-sectional view of the pump of the present invention.

Also referring to FIGS. 2–4, the pump 10 comprises a casing defining an upper chamber 16 and a lower chamber 15. A cylinder (not labeled) extends from the upper chamber 16 into the lower chamber 15 and defines a bore that is isolated from the interior space of the lower chamber 15. A fixed shaft 18 coaxially extends through the bore of the cylinder. The upper chamber 16 forms a cylindrical interior space substantially coaxial with the shaft 18 for accommodating a blade assembly. The blade assembly is comprised a plurality of blades 22 integrally and radially extending from a hub (not labeled) that is rotatably fit over the shaft 18 and a first permanent magnet 21 having a cylindrical shape coaxially and securely attached to the hub of the blade assembly and defining a central hole (not labeled) for rotatably fit over the shaft 18, serving as a rotor of the pump. Thus, the blade assembly is allowed to rotate inside the upper chamber and the cylinder extending from the upper chamber.

An outlet tube 17 extends from a side wall of the upper chamber 16 and is in fluid communication with the interior space of the upper chamber 16, whereby coolant that is expelled by the blades 22 is allowed to discharge through the outlet tube 17. The upper chamber 16 has an opening (not labeled) for receipt of the blade assembly and is closed by a lid 19 from which an inlet tube 20 extends. The inlet tube 29 is connected to the radiator 12 to receive the coolant therefrom and guide the coolant into the upper chamber 16 of the pump 10.

A second, electrical magnet is received in the lower chamber 15, comprised of a plurality of silicon steel plates 23 disposed around the cylinder and thus the first magnet 21, serving as a stator. When the silicon steel plates 23 are energized, a magnetic field is generated, which interacts with a magnetic field of the first magnet 21 and drives the rotation of the first magnet 21 and the blade assembly about the shaft 18.

Figure 5:
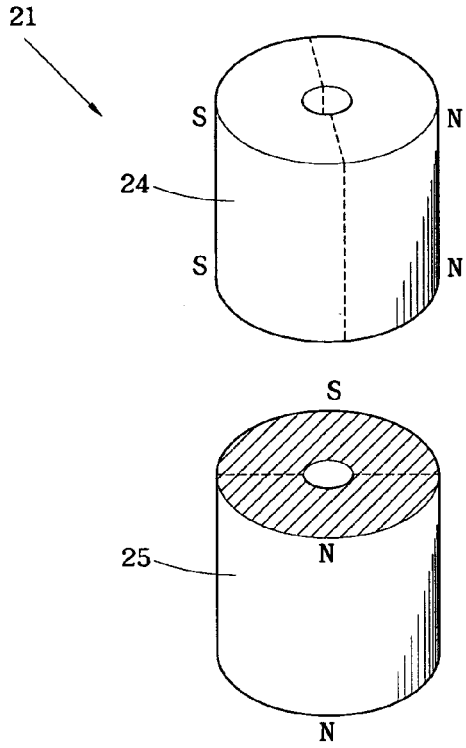
FIG. 5 is a schematic perspective view of a permanent magnet in accordance with the present invention.
Figure 6:
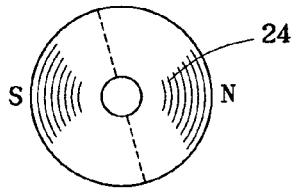
FIG. 6 is an axial end view of an upper element of the permanent magnet in accordance with the present invention.
Figure 7:
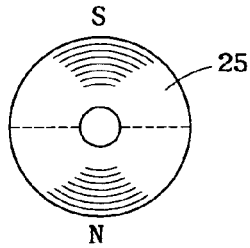
FIG. 7 is an axial end view of a lower element of the permanent magnet in accordance with the present invention.

Also referring to FIGS. 5–7, the first magnet 21 is comprised of an upper cylindrical magnet element 24 and a lower cylindrical magnet element 25 that are coaxially stacked and fixed. Both the upper and lower magnet elements 24, 25 are comprised of semi-circular portions of north and south poles, respectively designated with characters "N" and "S", which are imaginarily separated by phantom lines shown in FIGS. 5–7. The upper and lower magnet elements 24, 25 are stacked in such a manner that the magnetic poles thereof alternate with each other in a non-symmetric manner. In other words, the north poles of the upper and lower elements 24, 25 are angularly offset or shifted from each other by an angle rather than 90 or 180 degrees, or a multiplicity of 90 degrees.

The non-symmetric alternating arrangement of the upper and lower elements 24, 25 of the first magnet 21 allows a first one of the elements 24, 25 to stay at a position that the magnetic poles thereof are in magnetic attraction with the poles of the second magnet 23, while a second one of the elements 24, 25 is at a position that the magnetic poles thereof are in a magnetic repulsion with the poles of the second magnet 23. In other words, even when the magnet 21 is in a stationary condition, at least one of the elements 24, 25 is in repulsion with the second magnet 23. This allows the rotor of the pump to start rotating in an effortless and smooth manner. Thus, vibration or shake occurring at the starting of a conventional water pump is effectively eliminated.

The non-symmetric alternating arrangement of the upper and lower halves of a cylindrical magnet does not increase the overall size of the magnet, nor does the space occupied by the cooling device, while effectively enhancing the performance of the pump and thus improving the efficiency of heat removal of the cooling device. In addition, such a non-symmetric alternating arrangement of the upper and lower halves of a cylindrical magnet does not complicates the overall construction of the water pump, while more efficiently removing heat from the heat generating device, such as a computer.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A pump adapted to circulate a coolant between a radiator and a water tray positionable on a heat generating device of a computer system for removing heat from the heat generating device, the pump comprising:

a casing forming a lower chamber and an upper chamber, an outlet formed in a side wall of the upper chamber for discharging the coolant;

a lid closed an upper opening of the upper chamber and forming an inlet adapted to receive the coolant;

a blade assembly comprised of a plurality of blade received in the upper chamber and rotatable about a shaft and a first permanent magnet coaxially attached to the blades; and a second electrical magnet accommodated in the lower chamber and surrounding the first magnet, whereby a magnetic force is induced between the first and second magnets to drive rotation of the blade assembly about the shaft;

wherein the first magnet is comprised of an upper section and a lower section, each comprised of a semi-circular north pole portion and a semi-circular south pole portion, the upper and lower sections being stacked in a non-symmetric alternating manner with respect to each other.

2. The pump as claimed in claim 1, wherein the non-symmetric alternating stack of the upper and lower sections comprises angularly shifting the upper section with respect to the lower section.

3. The pump as claimed in claim 2, wherein the angular shift comprises an angle rather than 90 or 180 degrees.

* * * * *